United States Patent [19]

Dworak et al.

[11] Patent Number: 4,519,359

[45] Date of Patent: May 28, 1985

[54] MULLITE PLATE

[75] Inventors: Ulf Dworak, Baltmannsweiler; Hans Olapinski, Aichwald; Dieter Fingerle, Hochdorf; Ulrich Krohn, Leonberg, all of Fed. Rep. of Germany; Martti J. A. Hakulinen, Rönninge; Bengt N. J. Palm, Nykvarn, both of Sweden

[73] Assignee: Feldmühle Aktiengesellschaft, Düsseldorf, Fed. Rep. of Germany

[21] Appl. No.: 585,172

[22] Filed: Mar. 1, 1984

[30] Foreign Application Priority Data

Mar. 1, 1983 [DE] Fed. Rep. of Germany ..... 3307115

[51] Int. Cl.[3] ..... F02F 1/24

[52] U.S. Cl. ..... 123/668; 123/193 H

[58] Field of Search ..... 123/668, 669, 193 R, 123/193 H, 193 CH

[56] References Cited

U.S. PATENT DOCUMENTS

| | | | |
|---|---|---|---|
| 3,115,127 | 12/1963 | Spencer et al. | 123/669 |
| 4,074,671 | 2/1978 | Pennila | 123/668 |
| 4,188,309 | 2/1980 | Volker et al. | 60/302 |
| 4,254,621 | 3/1981 | Nagumo | 123/669 |
| 4,328,772 | 5/1982 | Heydrich et al. | 123/669 |
| 4,398,527 | 8/1983 | Rynbrandt | 123/668 |

FOREIGN PATENT DOCUMENTS

| | | | |
|---|---|---|---|
| 0147036 | 6/1952 | Australia | 123/669 |
| 2061383 | 4/1981 | United Kingdom | 123/668 |

*Primary Examiner*—Craig R. Feinberg
*Attorney, Agent, or Firm*—Felfe & Lynch

[57] ABSTRACT

In a cylinder head of a piston engine, the surface of the cylinder head facing the combustion chamber is covered by a plate having openings for valves, spark plugs or injection nozzles. The plate consists of mullite containing 2 to 30% by volume of zirconium oxide and/or hafnium oxide embedded therein, plus 0 to 3 mole-percent of oxides of magnesium, calcium or yttrium, with respect to the zirconium and/or hafnium oxide, and of no more than 0.5%, by weight, of other oxidic impurities.

5 Claims, 2 Drawing Figures

MULLITE PLATE

BACKGROUND OF THE INVENTION

The present invention relates to a cylinder head of a piston engine, which has a thermal insulation component made by sintering from ceramic materials, and which has openings for valves, spark plugs or injection nozzles.

For the prevention of wall losses, it has previously been proposed in German Offenlegungsschrift No. 2,821,506 to cover the inside surface of a cylinder head with a laminated insulating plate. The laminated insulating plate described consists of the actual insulating layer and a metal backing plate tightly joined thereto. The insulating layer faces the combustion chamber and consists either of vitreous fused silica, or of silicon nitride or silicon carbide, and it is either fused or sintered onto the metal backing plate, or the insulating layer is of laminated construction with an especially porous middle layer which is formed preferably of spheres of the insulating material. In such a cylinder head it is disadvantageous that the usual arrangement of several separate openings for valves, spark plugs and injection nozzles is difficult to achieve, and consequently it is necessary to have only a single opening in the laminated insulating plate. Another disadvantage lies in the complexity of construction, especially in the fact that the actual insulating layer, on account of its low stength, requires a metal backing plate.

German Offenlegungsschrift No. 3,039,718 disclosed a cylinder head in which a refractory body consisting of silicon nitride is inserted into a thermal insulation component consisting of aluminum titanate, and this laminate is shrink-fitted into a metal supporting body, which in some cases is formed by the cylinder head. The refractory body, which forms the bottom of the cylinder head, faces the combustion chamber and protects the thermal insulation component against mechanical stress. The thermal insulation component is in the form of a circular disk having a marginal rim to accommodate the refractory body. Here, again, the disadvantage is the laminated construction of the individual components consisting of different materials, which is necessitated by the low strength of aluminum titanate. Another disadvantage is that the laminate consisting of the thermal insulation component and the refractory body cannot be subjected to clamping pressure, and instead must be provided with a supporting body to protect the aluminum titanate.

In the publication by Woods/Oda, "PSZ"-Ceramics for Adiabatic Engine Components, published in the SAE Technical Papers Series, cylinder heads having shrink-fitted plates of partially stabilized zirconium oxide (PSZ) have been disclosed, but they have not found acceptance because the thermally induced tensions due to the high thermal expansion of zirconium oxide, especially in the area of the valve bores, result in cracking, particularly in the radial direction.

In short, in the state of the art, cylinder heads having thermal insulation components are known, in which these components are made from materials which have either a low thermal expansion and low thermal conductivity combined with low strength (aluminum titanate), or from materials which have a low thermal conductivity and a high strength, but also have a high thermal expansion (zirconium oxide). None of these known proposals have proven adequate.

The object of the present invention lies in the development of a cylinder head which will have a good insulating action on the combustion chamber side, while at the same time demanding that the component that provides the insulation have a long useful life, even under intensified stress. The invention intends especially to make available a cylinder head having a thermal insulation component which will have excellent strength for resisting mechanical forces and especially thermally induced tensions.

It is also the aim of the invention to make available a thermal insulation component having a simple construction, which is to be installed in the cylinder head in a simple and easy manner, and which at the same time will be given a firm seating in the cylinder head. The invention intends also to create a component which will render unnecessary the separate manufacture and assembly of valve seats made from another material, and will make it possible to form the valve seats directly in the thermal insulation component.

THE INVENTION

It has now been found that the above-described problem can be solved by covering the cylinder head surface facing the combustion chamber in an internal combustion engine, with a circular plate shrink-fitted or gripped in the cylinder head, and consisting of: 2 to 30 vol.% of zirconium oxide and/or hafnium oxide, with the addition of 0 to 3 mol.% of the oxides of magnesium, calcium or yttrium with respect to zirconium oxide and/or hafnium oxide, other oxidic impurities amounting to no more than 0.5% by weight, balance mullite.

The present invention makes it possible to produce a thermal insulation component having excellent insulating action, without the need for the component to have a laminated insulating layer or a supporting plate such as those described in German Offenlegungsschrift No. 2,821,506. The present invention also makes it possible to eliminate the refractory body required in German Offenlegungsschrift No. 3,039,718 for the protection of the thermal insulating component. Lastly, the invention also succeeds in producing a component that is simple in its construction and easy to install, which has a substantially longer useful life than the known plates of zirconium oxide.

The outstanding practicality of the plate to be used in accordance with the invention in a cylinder head is surprising due to the fact that mullite with zirconium oxide imbedded in it does not have the high strength valves of partially stabilized zirconium oxide. Thus, it was not to be expected that a plate made from mullite with zirconium oxide imbedded in it would withstand the high tensions induced by thermal stress, which occur in the cylinder head of an internal combustion engine. Probably, however, this can be explained by the fact that, due to the low thermal expansion, the tensile stresses acting on the outside margin of the plate remain lower than the tensile strength of the material. In a cylinder head of the invention, in which the plate is fastened in place by shrink-fitting, an additional safety factor is provided on the basis of the prestressing thereby produced, which counteracts the thermally induced tensile forces.

The relatively good strength of the plate made from mullite with embedded zirconium oxide makes it possible to construct the cylinder head such that the plate gripped or shrink-fitted into the cylinder head can also serve as a sealing means between the engine block and cylinder head.

In an especially preferred embodiment, the cylinder head is characterized by the fact that valve seats are machined in the circulate plate. The fact that the valve seats are made from the same material from which the thermal insulation component is made constitutes an additional simplfication. The valve seats can be made of such a thickness that they exceed the thickness of the circular plate and can be fastened additionally in the cylinder head.

In an especially preferred embodiment, the cylinder head is distinguished by the following features of the circular plate:

(a) a material composition of:

7 to 25 vol.% of zirconium oxide and/or hafnium oxide, with the addition of 1 to 2.8 mol.% of one or more oxides of magnesium, calcium and yttrium, with respect to zirconium oxide and/or hafnium oxide, 0 to 0.5 wt.% of other oxidic impurities, remainder mullite, all parts making up a total of 100%, (b) an ultimate flexural strength $\delta_B$ greater than 250 MPa, (c) a toughness $K_{Ic}$ of at least 3.0 MPa $\sqrt{m}$, (d) a thermal conductivity $\lambda < 6W/(m.K)$, (e) a modulus of elasticity of less than 220 GPa, (f) a linear thermal expansion $\alpha$ of less than $5.5 \times 10^6 K^{-1}$.

Very preferentially, a mullite containing embedded zirconium oxide has substantially higher values, the breaking strength being preferably greater than 300 MPa, and very preferentially higher than 450 MPa. It is also preferred that the toughness $K_{Ic}$ be greater than 3.4 MPa $\sqrt{m}$, and the modulus of elasticity less than 200 GPa. The porosity of the circular plate is preferably less than 3%, and very preferentially less than 2%.

The production of the circular plate is not tied to the use of particular starting raw materials. For example, what is known as fused mullite can be used, to which zirconium oxide is added, but the starting material can also be aluminum oxide and zirconium silicate. Special importance is to be given to the grain size of the zirconium oxide. The average grain size in the sintered circular plate should be no greater than 2 microns, but should preferably be between 0.1 and 1.0 microns. It is preferred that between 10 and 70% of the embedded zirconium oxide be in the tetragonal modification, as measured by the X-ray diffraction method on the unmachined, fired surface.

The circular plate can be produced by sintering compacts at temperatures between 1400° and 1700° C. A further improvement of the material properties can be achieved by a hot isostatic after-pressing at a maximum of 1650° C. for a maximum of one hour at a maximum of 1000 bar.

The appended drawings will serve for the further explanation of the invention, although the invention is not limited to the embodiments shown.

DESCRIPTION OF PREFERRED EMBODIMENTS

Figure 1:
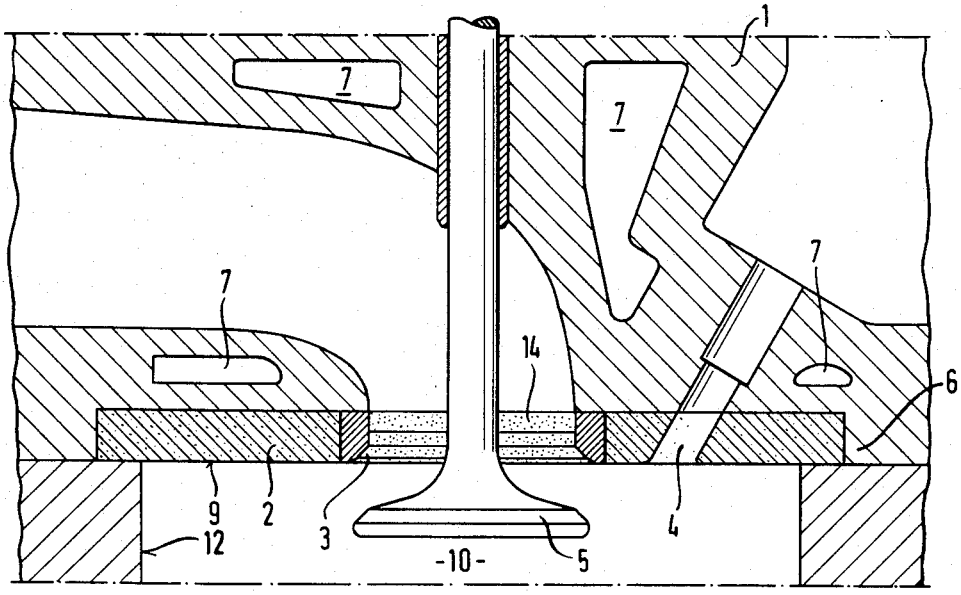
FIG. 1 is a longitudinal cross section, corresponding to line I—I of FIG. 2, taken through an embodiment of the cylinder head.

In FIG. 1 there is shown a cylinder head 1 into which a circular plate 2 is shrink-fitted within a rim 6 formed in the cylinder head. The circular plate 2 is composed of 22 wt.% (=12.9 vol.%) of zirconium oxide to which 1.4 mol.% of magnesium oxide has been added, 77.8 wt.% (=87.02 vol.%) of mullite, and 0.1 wt.% (=0.08 vol.%) of oxidic impurities such as silica and soda. The average grain size of the zirconium oxide embedded in the mullite amounts to 1.1 micron; 16% of the zirconium oxide is in the tetragonal modification. The circular plate 2 forms the greater part of the cylinder head bottom 9 and divides the cylinder head 1 from the combustion chamber formed by the cylinder walls 12 and a piston which is not shown. A valve sheet 3 of steel is formed in the circular plate 2. A bore 4 serves for the insertion of an injection nozzle which is not shown. The figure furthermore shows a valve 5 and cooling water passages 7. It can be seen that a seal can be made directly between the circular plate and the engine block containing the cylinder bore.

Figure 2:
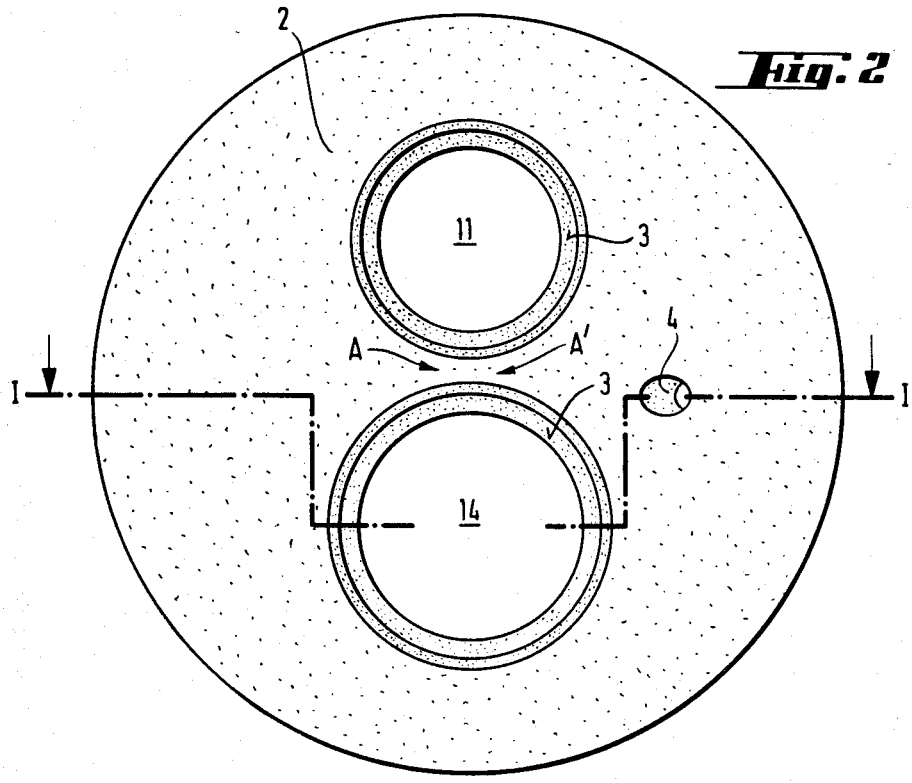
FIG. 2 is a bottom view of the flat circular disk of mullite containing embedded zirconium oxide, which is shown in FIG. 1 as the thermal insulating component.

FIG. 2 shows the circular plate 2 described in conjunction with FIG. 1, bores 11 and 14 being provided for the intake and exhaust valves. Valve seats 3 of steel are let into the circular plate 2. A bore 4 serves, as mentioned above, for the insertion of an injection nozzle. Arrows A, A', indicate the area of the circular plate which is normally greatly endangered by thermally induced tensions, but in accordance with the present invention, the thermally induced tensions are situated outside of this critical area.

It will be understood that the specification and examples are illustrative but not limitative of the present invention and that other embodiments within the spirit and scope of the invention will suggest themselves to those skilled in the art.

What is claimed is:

1. In a cylinder head of a piston engine having a thermal insulation component in the form of a planar plate made by sintering from ceramic materials and which has openings therethrough, the improvement comprising said thermal insulation component substantially covering the surface of the cylinder head facing the combustion chamber and being shrink-fitted or gripped in the cylinder head, said insulation component consisting of: 2 to 30 vol.% of a first oxide selected from the group consisting of zirconium oxide and hafnium oxide; from about 1 to 3 mol.% of a second oxide selected from the group consisting of oxides of magnesium, calcium, yttrium and a mixture thereof, with respect to said first oxide; a maximum of 0.5 wt.% of other oxidic impurities; and the remainder mullite to make up 100 vol.%.

2. The component of claim 1 further comprising valve seats machined therein.

3. The cylinder head of claim 1 wherein said thermal insulation component is in the form of a circular planar plate.

4. The cylinder head of claim 2, wherein valve seats are machined into the circular plate.

5. The cylinder head of claim 3, wherein said circular plate has:

(a) a composition of 7 to 25 vol.% of a said first oxide, 1 to 2.8 mol.% of said second oxide, with respect to said first oxide; up to 0.5 wt.% of other oxidic impurities; and the remainder mullite to make up a total of 100 vol.%

(b) an ultimate flexural strength greater than 250 MPa;

(c) a toughness $K_{Ic}$ of at least 3.0 MPa $\sqrt{m}$;

(d) a thermal conductivity greater than 6W/(m.K);

(e) a modulus of elasticity greater than 220 GPa; and (f) a linear thermal expansion greater than $5.5\times10^{-6}K^{-1}$.

* * * * *

UNITED STATES PATENT AND TRADEMARK OFFICE

CERTIFICATE OF CORRECTION

PATENT NO. : 4,519,359

DATED : May 28, 1985

INVENTOR(S) : Ulf Dworak, et al.

It is certified that error appears in the above-identified patent and that said Letters Patent is hereby corrected as shown below:

Column 2, line 52 "valves" should be -- values --.

Column 4, line 20 "sheet" should be -- seat --.

Signed and Sealed this

*Twelfth* Day of *November 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,519,359

DATED : May 28, 1985

INVENTOR(S) : Dworak et al.

It is certified that error appears in the above-identified patent and that said Letters Patent is hereby corrected as shown below:

Column 3, line 32, "$10^{6}$" should be -- $10^{-6}$ --.

Claim 5, lines 11, 12 and 13, "greater" should be -- less --.

Signed and Sealed this

*Twenty-fifth* Day of *March 1986*

[SEAL]

*Attest:*

DONALD J. QUIGG

*Attesting Officer*

*Commissioner of Patents and Trademarks*